United States Patent [19]

Gedney

[11] 3,962,757

[45] June 15, 1976

[54] FABRIC FASTENER

[76] Inventor: John F. Gedney, P.O. Box 960, Boston, Mass. 02103

[22] Filed: Mar. 17, 1975

[21] Appl. No.: 559,124

[52] U.S. Cl. ..... 24/255 BS; 24/30.5 S; 24/72.5; 24/81 F; 206/486; 211/89

[51] Int. Cl.[2] ..... A44B 21/00; B65D 77/10

[58] Field of Search..... 24/255 G, 255 BS, 255 HE, 24/30.5 S, DIG. 28, 19, 29, 81 F, 72.5, DIG. 29; 206/486, 466; 248/314; 211/89; 223/87, DIG. 1; 132/46 R; 5/320

[56] References Cited

UNITED STATES PATENTS

| | | | |
|---|---|---|---|
| 822,728 | 6/1906 | Earl | 24/DIG. 28 |
| 1,389,304 | 8/1921 | Holmes | 24/DIG. 28 |
| 2,030,996 | 2/1936 | Lustig | 24/30.5 S |
| 2,095,195 | 10/1937 | MacDonald | 24/255 BS |
| 2,457,274 | 12/1948 | Rifken | 24/255 BS |

FOREIGN PATENTS OR APPLICATIONS

| | | | |
|---|---|---|---|
| 684,419 | 9/1961 | Canada | 24/30.5 S |
| 479,741 | 4/1953 | Italy | 24/255 BS |
| 1,229,139 | 4/1971 | United Kingdom | 24/255 BS |

*Primary Examiner*—Bernard A. Gelak

*Attorney, Agent, or Firm*—Morse, Altman, Oates & Bello

[57] ABSTRACT

A fastener having a resilient body that is formed with a plurality of grips, each of which includes a plurality of teeth for captively holding webs of fabric-like material. Each grip constitutes a corrugated slit that is formed with an opening at each of its ends. Adjacent slits cooperate with one another, when the fastener is disposed in a gripping position, and captively hold the webs in a contour configuration that defines a fitted corner. The openings at the slit ends are operative to facilitate reversal of the fastener position for removing the captively held webs.

10 Claims, 6 Drawing Figures

FABRIC FASTENER

BACKGROUND OF THE INVENTION

1. Field of the Invention

The present invention relates to web fastening devices, and, more particularly, is directed towards fastening devices for captively holding fabric-like webs such as bedclothes.

2. Description of the Prior Art

Web fastening devices of various configurations have been manufactured for holding bedclothes. One type fastener includes a resilient loop to which the bedclothes are clamped. Another type includes a plurality of coils through which the bedclothes are inserted. Bedclothes fasteners have been introduced to the public with varying degrees of success.

SUMMARY OF THE INVENTION

It is an object of the present invention to provide a fastener for captively holding fabric-like sheet materials. The fastener of the present invention is characterized by a resilient planar body that is formed with a plurality of corrugated slits, an opening formed at the ends of each slit. The longitudinal axis of any one slit is in spaced parallel relationship with the longitudinal axis of any other slit, each slit having a plurality of teeth that define a grip for holding the fabric-like sheet material. Adjacent slits cooperate with one another, when the fastener is disposed in a gripping position, and captively hold the sheet materials. The openings at the slit ends are operative to facilitate reversal of the fastener position for removing the captively held sheets.

Another object of the invention is to provide a fastener of the foregoing type that is particularly adapted for captively holding bedclothes. Each corner of a bottom sheet, a top sheet, a blanket and a spread, at the foot end, is inserted into adjacent slits from the same side of the fastener, each piece of bedclothes being received in only one slit. The bedclothes enlarge the slit opening, and the teeth of each slit grip the bedclothes inserted therebetween, the fastener being in a gripping position. The teeth of adjacent slits cooperate to provide an increased gripping force against the bedclothes and to captively hold the bedclothes in a contour configuration that defines a fitted corner. The openings at the slit ends are operative to facilitate reversal of the fastener into a releasing position for removing the bedclothes from the fastener.

Other objects of the present invention will in part be obvious and will in part appear hereinafter.

The invention accordingly comprises the fastening device possessing the construction, combination of elements, and arrangement of parts that are exemplified in the following detailed disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFFERED EMBODIMENTS

Figure 1:
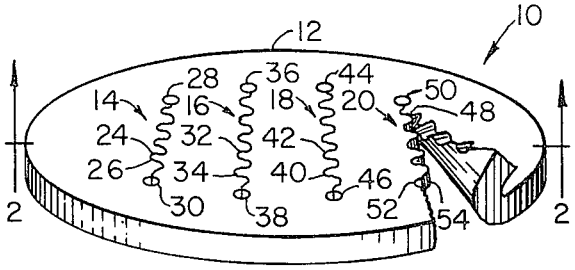
FIG. 1 is a perspective view of a fastening device embodying the invention.
Figure 2:
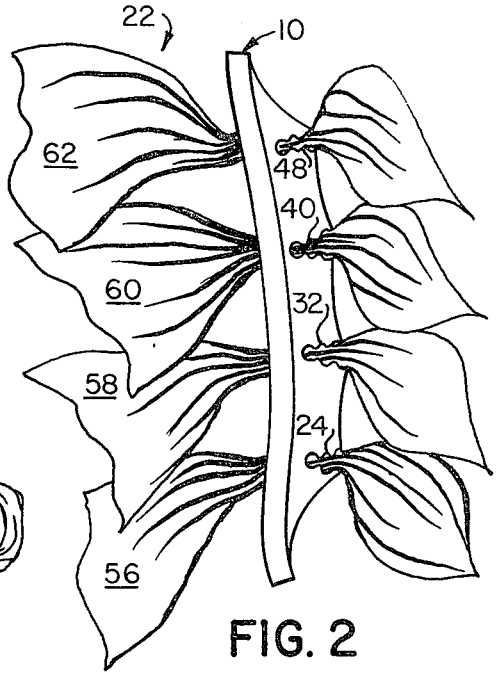
FIG. 2 is a perspective view of the fastening device of FIG. 1, in a gripping position, holding bedclothes.

Referring now to the drawings, particularly FIG. 1 and 2, it will be seen that a fastening device 10, which embodies the present invention, comprises a resilient body 12 that is formed with a plurality of elongated grips 14, 16, 18 and 20. In alternative embodiments the number of grips is other than four, for example, one, two, three, five or six or some other number. Body 12 has a diameter in the approximate range of 2 and one-half inches to 4 inches and a thickness in the approximate range of five hundredths of an inch to one-quarter of an inch. Each grip is operative to captively hold webs 22, for example sheets of fabric-like material such as bedclothes. Grip 14 includes a corrugated slit 24 having teeth 26 and a pair of holes 28, 30, opposite ends of slit 24 terminating in holes 28 and 30. Grip 16 includes a corrugated slit 32 having teeth 34 and a pair of holes 36, 38. The ends of slit 32 communicate with holes 36 and 38. Grip 18 is similar in construction to grip 16 and includes a corrugated slit 40 having teeth 42 and a pair of holes 44, 46. Grip 20 is similar in construction to grip 14 and includes a corrugated slit 48 and a pair of holes 50, 52, slit 48 having teeth 54. The longitudinal axis of any one of the grips 14, 16, 18 and 20 is in spaced parallel relationship with the other grips. The length of each slit is in the approximate range of three-quarters of an inch to 2 inches and the diameter of each hole at the slit ends is in the approximate range of five hundredths on an inch to one-quarter of an inch. The average peak to valley height of the teeth is in the approximate range of five hundredths of an inch to one-quarter of an inch. As hereinafter described, grips 14, 16, 18 and 20 cooperate with one another to captively hold bedclothes 22 in a contour configuration that defines a fitted corner.

In the illustrated embodiment, by way of example, the profile of body 12 is generally circular having a diameter of approximately 3.25 inches and a thickness of approximately 0.125 inches. Body 12 is composed of a resilient material that is sufficiently flexible to receive bedclothes 22 within the grips and is sufficiently rigid to captively hold the bedclothes within the grips. In the preferred embodiment, body 12 is composed of a leather-like material such as leather having a weight in the range of 5 to 12 ounces per square foot and preferably in the range of 7 to 9 ounces per square foot. In alternate embodiments, body 12 is composed of a polymer, for example, an elastomer such as hard rubber or a plastic such as polypropylene. The length of each corrugated slits 24 and 48 is approximately 1 inch and the length of each corrugated slit 32 and 40 is approximately 1 and one-half inches. The diameter of the holes that bound each of the corrugated slits is approximately three thirty-seconds of an inch. The spacing between adjacent slits is approximately five-eights of an inch.

As best shown in FIG. 2, fastening device 10 is used by inserting bedclothes 22 into grips 14, 16, 18 and 20. In the illustrated embodiment, bedclothes 22 includes a bottom sheet 56, a top sheet 58, a blanket 60 and a spread 62. In use, first the corner of bottom sheet 56 is inserted into and pulled through corrugated slit 24. The portions of body 12 adjacent slit 24 bend outwardly towards the corner of bottom sheet 56. Next, the corner of top sheet 58 is inserted into and pulled through corrugated slit 32. The portions of body 12 adjacent slit 32 bend outwardly towards the corner of top sheet 58. It is to be noted that, as top sheet 58 is pulled through slit 32, teeth 26 of slit 24 and teeth 42 of slit 40 are pressed together. Likewise, when bottom sheet 56 is inserted into slit 24, teeth 34 of slit 32 are pressed together. Next, the corner of blanket 60 is inserted into and pulled through corrugated slit 40, teeth 34 of slit 32 and teeth 54 of slit 48 are pressed together. Finally, the corner of spread 62 is inserted into and pulled through corrugated slit 48. The portions of body 12 adjacent slit 48 bend outwardly towards the corner of spread 62. As spread 62 is pulled through slit 48, teeth 42 of slit 40 are pressed together. When each piece of bedclothes 22 is inserted through its correlative corrugated slit, body 12 assumes a generally concave profile in right cross section, the portions of body 12 adjacent the slits bowed outwardly to resist removal of the bedclothes, fastener device 10 being in a gripping position. Each peice of bedclothes 22 is captively held in its respective grip by the teeth associated therewith.

Figure 3:
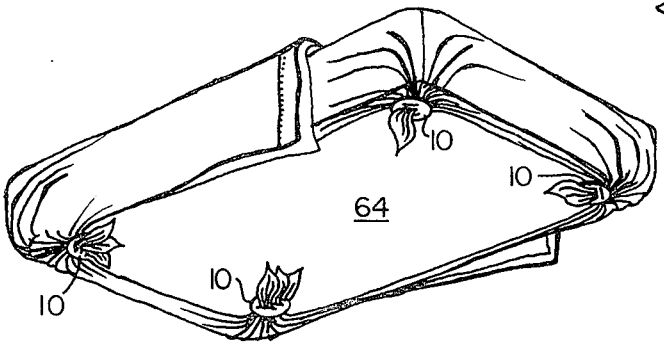
FIG. 3 is a perspective view of a matress having bedclothes thereon, a fitted corner formed by the fastening device of FIG. 1.

As best shown in FIG. 3, each piece of bedclothes 22 is held in a contour configuration that defines a fitted corner which corresponds to the corner of a mattress 64. After bedclothes 22 are inserted into and captively held in their respective grip, body 12 is tucked between mattress 64 and a box spring (not shown). FIG. 3 shows four fastening devices 10 for holding the bedclothes to the four corners of a bed. Depending upon the configuration that the bed is to be made up to, selected pieces of bedclothes are inserted into fastening devices 10 for holding the bedclothes to the mattress.

Figure 4:
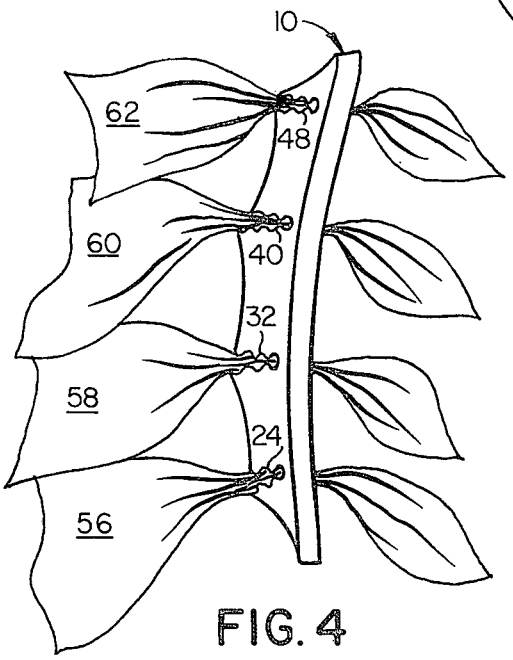
FIG. 4 is a perspective view of the fastening device of FIG. 1, in a releasing position, for removal of the bedclothes.

As shown in FIG. 4, in order to remove bedclothes 22 from fastening device 10, the bowed regions of the device are pushed inwardly until body 12 is bowed away from the bedclothes corners. That is, the portions of body 12 adjacent the slits are bowed inwardly to facilitate removal of the bedclothes, fastener device 10 being in a releasing position. It has been found that the holes at the slit ends permit inward bowing of body 12 away from the bedclothes corners for withdrawal of the bedclothes. In addition, it has been found that the holes at the slit ends permit outward bowing of body 12 when fastener device 10 is in the gripping position.

Figure 5:
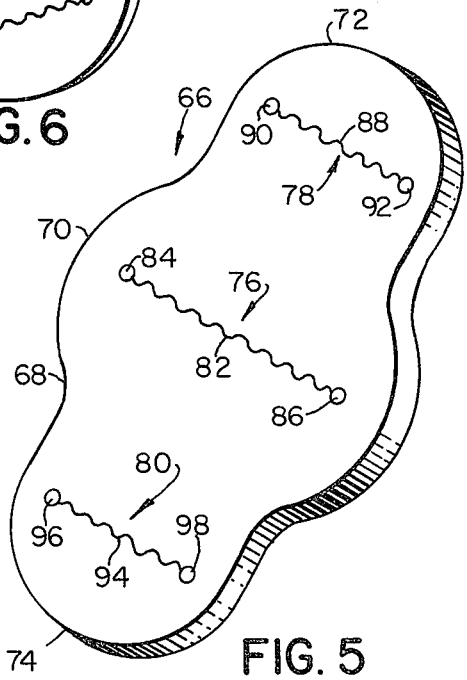
FIG. 5 is a perspective view of an alternative embodiment of the invention.

An alternative embodiment of the invention in the form of a fastening device 66 for captively holding tarpaulin is shown in FIG. 5. Fastening device 66 comprises a resilient body 68 having a wide medial region 70 and narrowed end regions 72 and 74. Medial region 70 is formed with a grip 76 that is disposed in substantially perpendicular relationship with the longitudinal axis of body 68. Regions 72 and 74 are formed with grips 78 and 80, respectively, which are disposed in spaced parallel relationship with grip 76. Body 68 is composed of a resilient material that is sufficiently flexible to receive the tarpaulin within grips 76, 78 and 80 and is sufficiently rigid to captively hold the tarpaulin within the grips. In the illustrated embodiment, body 68 is composed of a leather-like material such as leather having a weight in the range of 8 to 12 ounces. In alternate embodiments, resilient body is composed of a polymer, for example, an elastomer such as hard rubber or a plastic such as polypropylene. Grip 76 includes a corrugated slit 82 that terminates in holes 84, 86, the length of slit 82 being approximately 2 inches and the diameter of holes 84, 86 being approximately one-quarter of an inch. Grip 78 includes a corrugated slit 88 that terminates in holes 90 and 92, the length of slit 88 being approximately 1 and one-half inches and the diameter of holes 90, 92 being approximately one-quarter of an inch. Grip 80 includes a corrugated slit 94 that terminates in holes 96 and 98, the length of slit 94 being approximately 1 and one-half inches and the diameter of holes 96, 98 being approximately one-quarter of an inch. The use of fastening device 66 is similar to that described in connection with fastening device 10.

Figure 6:
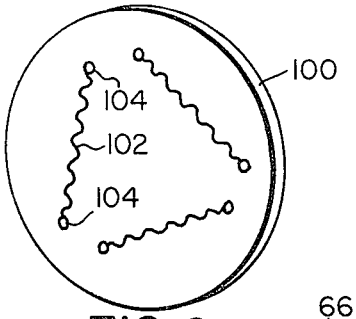
FIG. 6 is a perspective view of yet another embodiment of the invention.

Referring now to FIG. 6 there is shown a fastening device 100 for holding diapers which includes grips 102 that are disposed in a triangular configuration, each grip terminating in holes 104. The structure of grips 102 is substantially similar to grip 14 and fastening device 100 is used as described in connection with fastening device 10.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. A device for holding a plurality of sheets of fabric-like material in a contoured configuration, said device comprising a resilient body formed with at least first, second, third and fourth grips, said first grip constituting a first corrugated slit that is bounded by a pair of holes at its ends, said second grip constituting a second corrugated slit that is bounded by a pair of holes at its ends, said third grip constituting a third corrugated slit that is bounded by a pair of holes at its ends, said fourth grip constituting a fourth corrugated slit that is bounded by a pair of holes at its ends, a longitudinal axis of any one slit being in spaced parallel relationship with a longitudinal axis of any other slit, at least one of said slits being longer in length than at least one other of said slits each of said slits configured to receive and captively hold a sheet of fabric-like material in a contoured configuration that constitutes a fitted corner, said slits arranged in such a manner that a sheet of fabric-like material inserted into one of said slits is operative to close said slits adjacent said one slit, said body in a bowed configuration when said sheets are received in said slits.

2. The device as claimed in claim 1 wherein said resilient body is composed of a resilient material that is sufficiently flexible to receive the web within said slit and is sufficiently rigid to captively hold the web within said slit.

3. The device as claimed in claim 2 wherein said resilient body is composed of a leather-like material.

4. The device as claimed in claim 3 where in said leather-like material is leather having a weight in the range of 5 to 12 ounces per square foot.

5. The device as claimed in claim 4 wherein said second and third slits are disposed between said first and fourth slits, said second and third slits longer than said first and fourth slits, said second and third slits being of equal length, said first and fourth slits being of equal length.

6. The device as claimed in claim 5 wherein said length of said first and fourth slits is approximately 1 inch, said length of said second and third slits is approximately 1 and one-half inches, said body having a thickness of approximately one-eighth of an inch, the spacing between adjacent slits being approximately five-eighths of an inch.

7. A device for captively holding sheets of fabric-like materials, said device comprising a resilient body formed with at least two opened slits and at least two pair of holes, one of said slits bounded by one pair of said holes and the other of said slits bounded by the other pair of said holes, said slits together with said holes forming a strip that is resiliently movable between said slits, each said slit defining a grip for receiving a sheet of the fabric-like material, said slits cooperating with one another for captively holding the sheets, said slits in spaced parallel relationship, said body is composed of a sufficiently flexible and sufficiently rigid material and said slits are spaced apart such a distance that a sheet of fabric-like material inserted into one of said slits closes the other of said slits, each said pair of holes operative to facilitate bowing of said resilient body outwardly into a gripping position and inwardly into a releasing position, said body having a generally bowed configuration when said sheets are received in said grips.

8. The device as claimed in claim 7 wherein said resilient body is composed of a resilient material that is sufficiently flexible to receive the sheets within said slits and is sufficiently rigid to captively hold the sheets within said slits, said resilient material being a leather-like material having a weight in the range of 5 to 12 ounces per square foot.

9. The device as claimed in claim 8 wherein the length of each slit is in the range of three-quarters of an inch to 2 inches and the diameter of each hole is in the range of five hundredths of an inch to one-quarter of an inch, said body has a generally circular profile having a diameter in the range of 2 and one-half inches to 4 inches and a thickness in the range of five hundredths of an inch to one-quarter of an inch.

10. The device as claimed in claim 9 wherein each said slit is a corrugated slit having a plurality of teeth for gripping one sheet of said fabric-like material, said teeth having a peak to valley height in the approximate range of five hundredths of an inch to one-quarter of an inch, said sheets of fabric-like material being bedclothes.

* * * * *